US009091111B2

(12) United States Patent
Popwell

(10) Patent No.: US 9,091,111 B2
(45) Date of Patent: Jul. 28, 2015

(54) SYSTEM AND METHOD FOR CONCEALING AND ACCESSING OBJECTS BEHIND A SURFACE

(71) Applicant: R. Scott Popwell, Kissimmee, FL (US)

(72) Inventor: R. Scott Popwell, Kissimmee, FL (US)

( * ) Notice: Subject to any disclaimer, the term of this patent is extended or adjusted under 35 U.S.C. 154(b) by 80 days.

(21) Appl. No.: 13/955,727

(22) Filed: Jul. 31, 2013

(65) Prior Publication Data

US 2015/0033994 A1 Feb. 5, 2015

(51) Int. Cl.

| | |
|---|---|
| ***E05G 1/02*** | (2006.01) |
| ***E04F 19/08*** | (2006.01) |
| ***E05G 1/024*** | (2006.01) |
| ***A47B 81/00*** | (2006.01) |
| ***F41C 33/06*** | (2006.01) |

(52) U.S. Cl.

CPC ..... *E05G 1/02* (2013.01); *A47B 81/005* (2013.01); *E04F 19/08* (2013.01); *E05G 1/024* (2013.01); *F41C 33/06* (2013.01); *E05G 2700/02* (2013.01)

(58) Field of Classification Search

CPC .... B66B 9/00; B66B 9/0226; B66B 11/0226; E05G 2700/02; E05G 1/02; E05G 1/024; E04F 19/08; E05B 65/0075; E05B 73/00; A47B 81/005; F41C 23/22; F41C 33/06

USPC ..... 70/57, 58, 63; 109/45, 47, 48, 53, 54, 109/58

See application file for complete search history.

(56) References Cited

U.S. PATENT DOCUMENTS

| | | | | | |
|---|---|---|---|---|---|
| 170,087 | A | * | 11/1875 | Howard | 187/259 |
| 895,581 | A | * | 8/1908 | Nygreen | 109/48 |
| 2,004,060 | A | | 6/1935 | Brown | |
| 2,553,965 | A | * | 5/1951 | Gist | 312/242 |
| 4,059,059 | A | | 11/1977 | Hughes | |
| 4,155,608 | A | | 5/1979 | Orlewicz | |
| 4,244,303 | A | | 1/1981 | Kurasik | |
| 4,369,717 | A | * | 1/1983 | Bollier | 109/45 |
| 1,509,285 | A | | 9/1984 | Colbow, Jr. | |
| 4,625,658 | A | | 12/1986 | Hodges | |
| 5,066,079 | A | | 11/1991 | Lawrence | |
| 5,111,755 | A | * | 5/1992 | Rouse | 109/25 |
| 5,203,619 | A | * | 4/1993 | Welsch et al. | 312/247 |
| 5,586,934 | A | | 12/1996 | Dombrowski et al. | |
| 5,901,589 | A | * | 5/1999 | Cordero | 70/63 |
| 6,865,993 | B2 | * | 3/2005 | Bartel et al. | 109/70 |
| 6,901,987 | B1 | * | 6/2005 | Graham | 160/121.1 |
| 7,004,287 | B1 | | 2/2006 | Barbara | |
| 7,178,370 | B2 | | 2/2007 | Engel | |
| 7,337,024 | B1 | * | 2/2008 | Graham et al. | 700/79 |
| 7,516,709 | B2 | * | 4/2009 | Bartel et al. | 109/70 |
| 7,850,411 | B2 | | 12/2010 | Solomon | |
| 2006/0076860 | A1 | * | 4/2006 | Hoss | 312/312 |
| 2006/0238086 | A1 | * | 10/2006 | Lai | 312/319.5 |
| 2009/0189497 | A1 | | 7/2009 | Stenbakken | |
| 2013/0113350 | A1 | * | 5/2013 | Lee | 312/224 |

* cited by examiner

*Primary Examiner* — Peter M Cuomo
*Assistant Examiner* — Amanda L Miller
(74) *Attorney, Agent, or Firm* — Cian G. O'Brien, Esq.; Robert L. Wolter, Esq.; Beusse Wolter Sanks & Maire, P.A.

(57) ABSTRACT

A system is provided for concealing and accessing objects behind an interior surface of a room. The system includes an opening defined by the interior surface and a mount in which valuables are secured and positioned in a cavity behind the interior surface of the room. The system further includes a décor element positioned at the opening. The system further includes an actuator assembly positioned in the cavity and operatively coupled to the mount and décor element to move the décor element from the opening and to move the mount to the opening to access the valuables. A method is also provided for concealing and accessing objects behind an interior surface of a room.

11 Claims, 9 Drawing Sheets

SYSTEM AND METHOD FOR CONCEALING AND ACCESSING OBJECTS BEHIND A SURFACE

BACKGROUND OF THE INVENTION

The present invention relates to a system and method for concealing valuables, and more particularly, to a system and method for concealing valuables behind an interior surface of a room, such as in a building.

There are many previously known wall safes which are designed to be recessed into the interior of a building wall. Such wall safes typically are combination or key operated safes and are frequently hidden behind pictures mounted to the wall. However, these conventional wall safes have a significant disadvantage. Since such wall safes are commonly hidden behind pictures mounted to the wall, experienced burglars or thieves can rapidly and easily locate the wall safe. Consequently, the hidden aspect of the wall safe provides no real advantage since the safe can be rapidly located.

Accordingly, it would be advantageous to provide a safe that is not easily located and thus can provide additional security for the owner of the valuables in the safe.

BRIEF DESCRIPTION OF THE INVENTION

In one embodiment of the present invention, a system is provided for concealing and accessing objects behind an interior surface of a room. The system includes an opening defined by the interior surface and a mount in which valuables are secured and positioned in a cavity behind the interior surface of the room. The system further includes a décor element positioned at the opening and an actuator assembly positioned in the cavity and operatively coupled to the mount and décor element to move the décor element from the opening and to move the mount to the opening to access the valuables.

In another embodiment of the present invention, a system is provided for concealing and accessing objects behind an interior surface of a room. The system includes a display mount positioned in the cavity, where valuables are secured to the display mount. The system further includes an opening defined by a surface of the cavity and a picture positioned at the opening and a frame mounted to the surface of the cavity around the opening. The system further includes an actuator assembly positioned in the cavity and operatively coupled to the display mount and the picture to move the picture through the opening and into the cavity and to move the picture and the display mount such that the display mount and the valuables are accessible through the opening.

In another embodiment of the present invention, a method is provided for concealing and accessing objects behind an interior surface of a room. The method includes providing an opening in the interior surface of the room. The method further includes positioning a display mount and a décor element in a first position behind the interior surface, where the décor element is positioned at the opening and the display mount is concealed in the cavity behind the interior surface. The method further includes positioning an actuator assembly in the cavity and operatively coupled to the décor element and the display mount. The method further includes actuating the actuator assembly to move décor element and the display mount to respective second positions where the décor element is concealed behind the interior surface and the display mount is positioned at the opening.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

In describing particular features of different embodiments of the present invention, number references will be utilized in relation to the figures accompanying the specification. Similar or identical number references in different figures may be utilized to indicate similar or identical components among different embodiments of the present invention.

Figure 1:
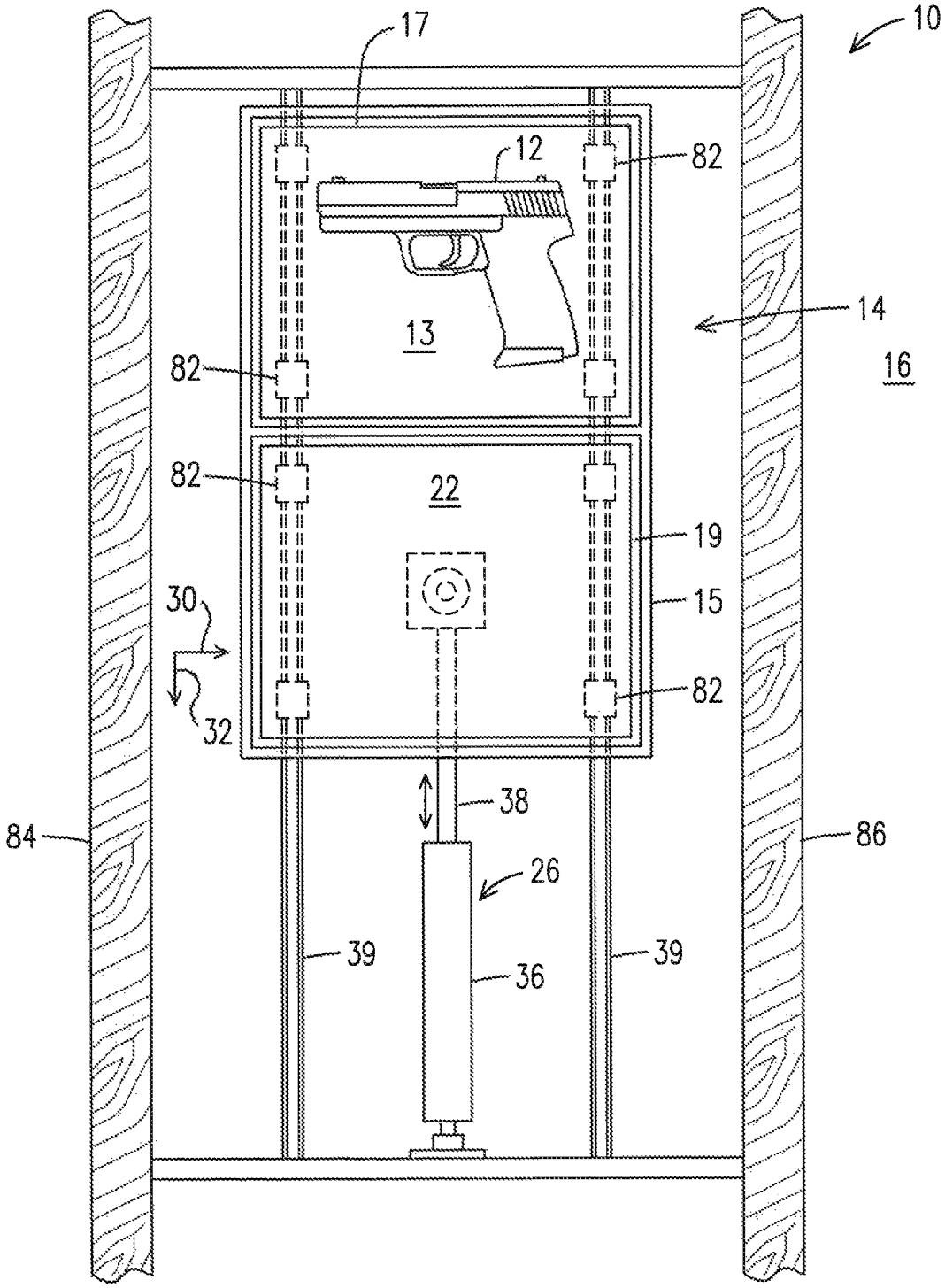
FIG. 1 is a partial cross-sectional front view of an exemplary embodiment of a system for concealing objects within a wall of a room according to the present invention.
Figure 2A:
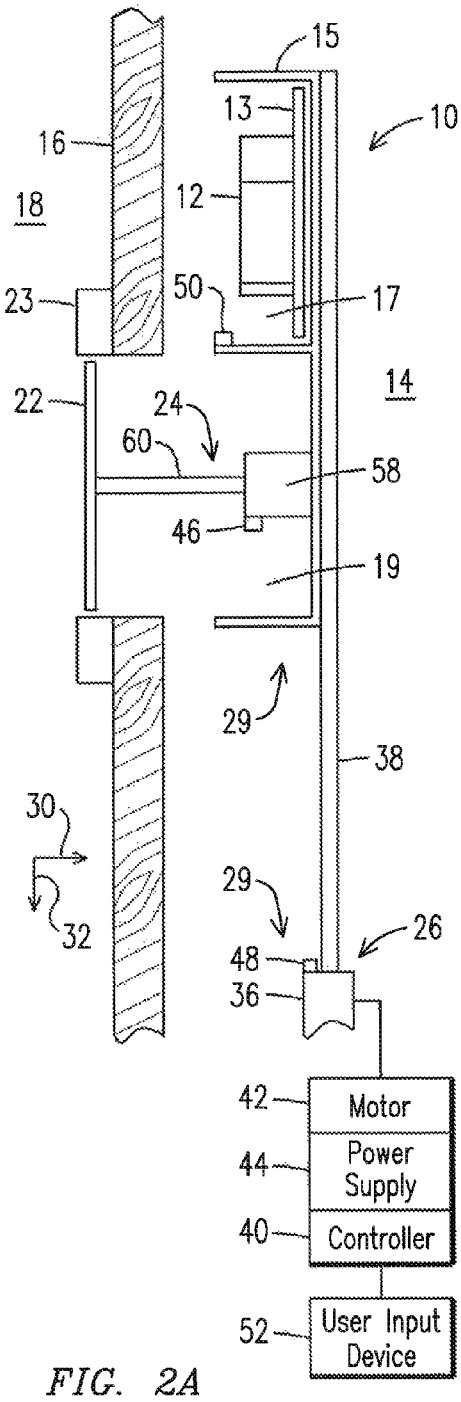
FIG. 2A is a cross-sectional side view of the system of FIG. 1 in an initial stage.
Figure 2B:
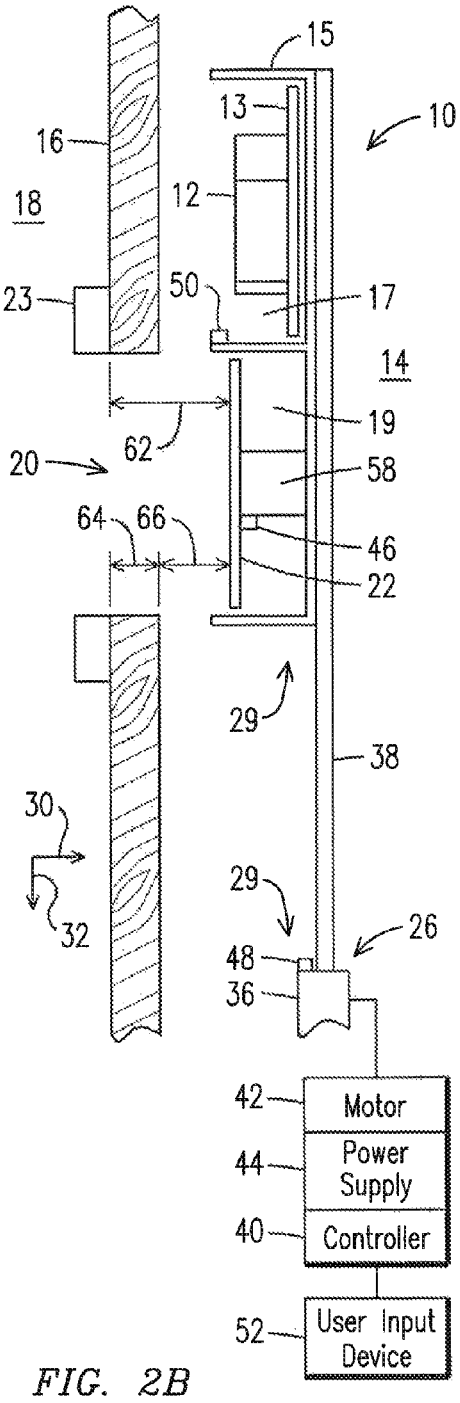
FIG. 2B is a cross-sectional side view of the system of FIG. 1 in an intermediate stage.
Figure 2C:
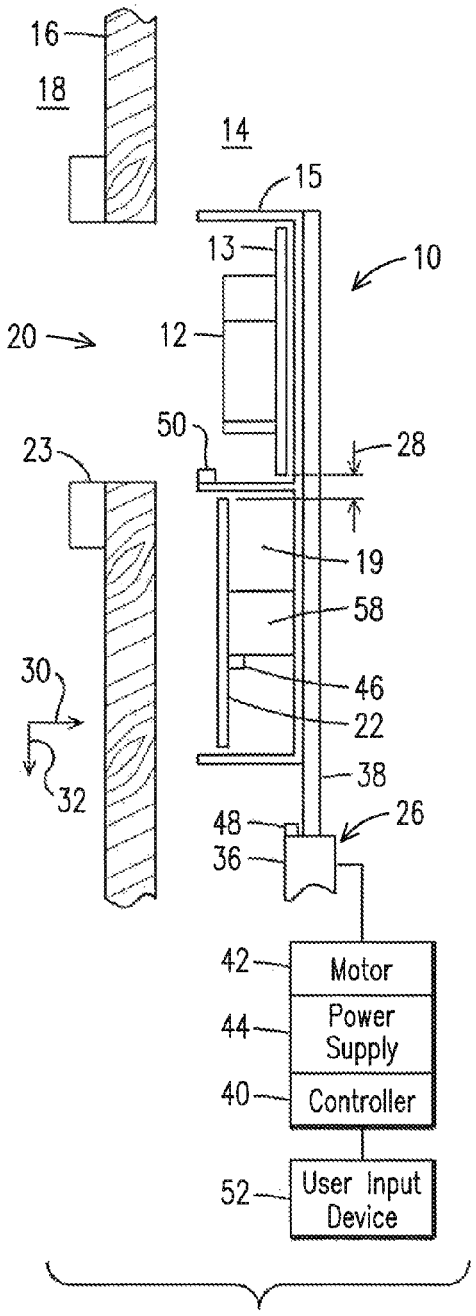
FIG. 2C is a cross-sectional side view of the system of FIG. 1 in a final stage.

FIG. 1 illustrates a system 10 for concealing and accessing concealed objects, such as a firearm 12 fixed to a display mount 13, for example. Although the embodiments of the present invention discuss the system 10 being used to conceal the firearm 12 fixed to the display mount 13, the system 10 may be used to conceal any type of valuable, such as jewelry, money, sensitive paperwork, or any valuable known to one skilled in the art. As illustrated in FIGS. 2A-2C, the display mount 13 is positioned in a housing 15 disposed within a cavity 14 behind an interior surface of a room, such as a wall 16, for example. Although the embodiments of the present invention discuss the system 10 being positioned in the cavity 14 behind the wall 16 of a room 18, the present invention is not limited to this arrangement and the system may instead be positioned in a cavity behind any interior surface of the room, such as a floor or a ceiling of the room, for example, with similar structural components and a method of operation as the system 10 discussed below. Additionally, although the embodiments of the present invention discuss the system 10 being positioned behind the wall 16 of a room 18 in a building, the system 10 is not limited to being positioned behind the wall 16 of a building, and may be positioned behind the wall of a moving vehicle, such as a recreational vehicle (RV), a water vessel, or any vehicle with a room having an interior surface, for example.

FIGS. 2A-2C illustrate various stages of operation of the system 10, from an initial stage (FIG. 2A) to an intermediate stage (FIG. 2B) to a final stage (FIG. 2C), when the system 10 is operated in a forward mode. However, the system 10 may also be operated in a reverse mode, from an initial stage (FIG. 2C), to an intermediate stage (FIG. 2B) and to a final stage (FIG. 2A), as discussed in greater detail below. FIGS. 2A and 2B illustrate that an opening 20 is defined by the wall 16, and that a décor element, such as a picture 22, is initially positioned at or in the opening 20. FIG. 2A illustrates that a stationary frame 23 of the picture 22 is secured to an outer surface of the wall 16, around the opening 20. Although the embodiments of the present invention discuss the use of the picture 22 as the décor element, the present invention is not limited to this arrangement, and includes the use of any décor element in place of the picture 22, during a user of the system 10, including a mirror, a vent cover, a tile within a floor of the room, and an attic cover within a ceiling of the room, for example.

As illustrated in FIG. 2A, an actuator assembly 29 is positioned in the cavity 14 and is operatively coupled to the display mount 13 and the picture 22 to move the picture 22 from the opening 20 and to move the display mount 13 to the opening 20 to access the firearm 12. The actuator assembly 29 includes a first actuator 24 positioned in a second portion 19 of the housing 15 and is connected to the picture 22. The first actuator 24 is configured to move the picture 22 in an orthogonal direction 30 relative to the wall 16, into or through the opening 20 and into the second portion 19 of the housing 15 within the cavity 14. As discussed above, the cavity need not be positioned behind the wall 16 of the room, and may be positioned behind any interior surface of the room. Regardless of which interior surface of the room is used to form the cavity, a first actuator is provided, to move the picture in a direction approximately orthogonal to the interior surface, through the opening in the interior surface and into the cavity. As further illustrated in FIG. 2A, the first actuator 24 is a linear actuator with a first member 58 that has a first diameter and a second member 60 that has a second diameter which is smaller than the first diameter. The linear actuator may be a hydraulic or pneumatic actuator, for example. The picture 22 is secured to the second member 60. In the forward mode, upon activation of the first actuator 24, the system 10 shifts from the initial stage (FIG. 2A) to the intermediate stage (FIG. 2B), during which the second member 60 of the first actuator 24 is received within the first member 58, until the picture 22 passes through the opening 20 and travels a threshold distance 62. As illustrated in FIG. 2B, the threshold distance 62 is a sum of a thickness 64 of the wall 16 and a minimum clearance threshold 66 of the picture 22 to pass beyond the wall 16 into the second portion 19 of the housing 15. The minimum clearance threshold may be adjusted to be any appropriate distance, in order to ensure that the picture 22 does not make contact with the wall 16 during the subsequent vertical actuation of the picture, as discussed below. Although FIG. 2A depicts the first actuator as a linear actuator, the first actuator is not limited to this type of actuator and may be any actuator capable of horizontally moving the picture 22 through the opening 20, as appreciated by one skilled in the art.

As further illustrated in FIG. 2A, the actuator assembly 29 further includes a second actuator 26 that is positioned in the cavity 14 and is connected along a back surface of the housing 15. As illustrated in FIG. 2C, the picture 22 is positioned within the second portion 19 of the housing 15 and the display mount 13 is positioned within the first portion 17 of the housing 15, such that the picture 22 and the display mount 13 are spaced apart by a threshold spacing 28. After the system 10 reaches the intermediate stage (FIG. 2B), the second actuator 26 may be activated, to shift the system 10 from the intermediate stage (FIG. 2B) to the final stage (FIG. 2C), during which the second actuator 26 moves the housing 15, and thus simultaneously moves the picture 22 and the display mount 13 along the cavity 14 until the display mount 13 (and firearm 12) are visible through the opening 20. The second actuator 26 is configured to move the housing 15 and thus simultaneously move the picture 22 and the display mount 13 in a vertical direction 32 approximately parallel to the wall 16. However, as discussed above, the cavity need not be positioned behind the wall of the room, and may be positioned behind any interior surface of the room. Regardless of which interior surface of the room is used to form the cavity, a second actuator is provided, to simultaneously move the picture and the display mount within the cavity and in a direction approximately parallel to the interior surface, until the display mount is visible through the opening.

As illustrated in FIGS. 1 and 2A, the second actuator 26 is a linear actuator with a first member 36 that has a first diameter and a second member 38 that has a second diameter that is smaller than the first diameter. The second member 38 is secured along the back surface of the housing 15 in which the picture 22 and display mount 13 are secured and thus the second member 38 simultaneously moves the picture 22 and the display mount 13 in the vertical direction 32. In the forward mode, upon activation of the second actuator 26, the system 10 shifts from the intermediate stage (FIG. 2B) to the final stage (FIG. 2C), during which the second member 38 of the second actuator 26 is received within the first member 36, until the display mount 13 (and firearm 12) are visible through the opening 20. Additionally, as illustrated in FIG. 1, a linear bearing assembly 82 are provided, to slidably secure the display mount 13 and the picture 22 to vertical rails 39 that are spaced apart on either side of the second actuator 26. Additionally, as illustrated in FIG. 1, the cavity 14 is positioned between two spaced apart wall studs 84, 86.

Figure 3:
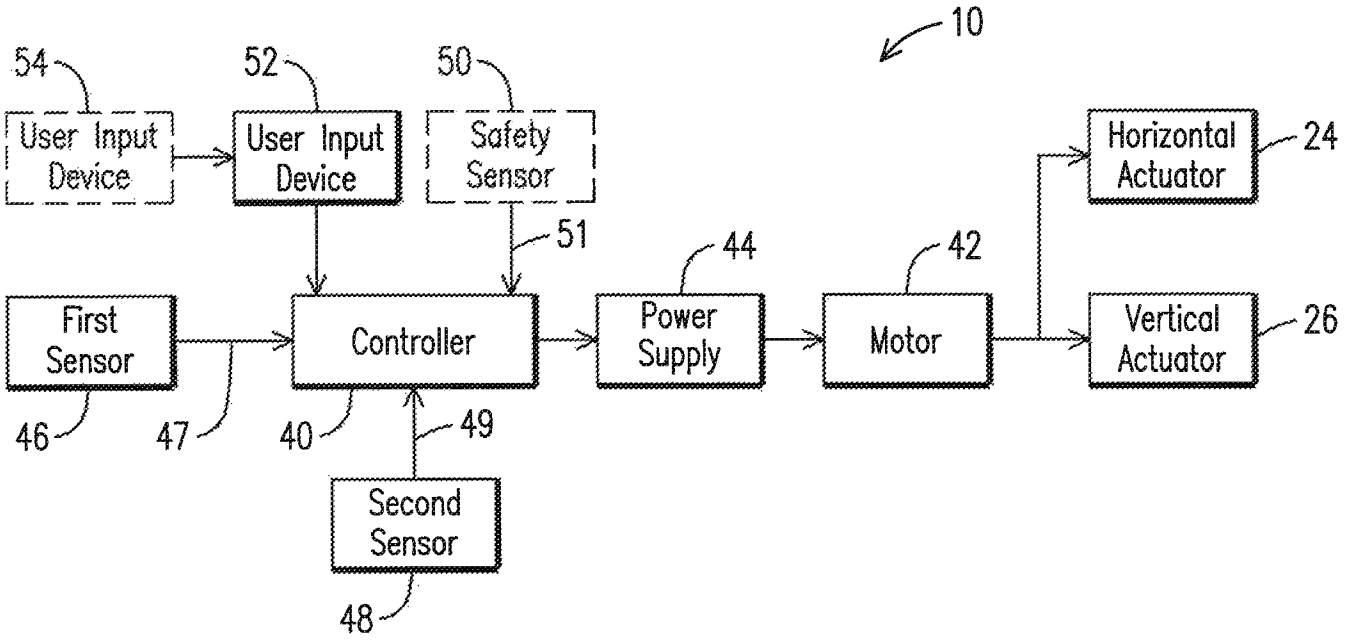
FIG. 3 is a block diagram of the system of FIG. 1.

FIG. 3 illustrates a block diagram of the system 10 and the connection between the components of the system 10. As illustrated in FIG. 3, the system 10 includes a controller 40 which activates a power supply 44, which in-turn activates a motor 42 that is used to activate either the first actuator 24 or the second actuator 26. However, the controller, power supply and motor may be embodied within one single component, such as a single controller element, for example. As discussed above, in an initial phase of the system 10 in the forward mode from the initial stage (FIG. 2A) to the intermediate stage (FIG. 2B), the controller 40 activates the power supply 44, which in-turn activates the motor 42 to activate the first actuator 24, so that the picture 22 moves by the threshold distance 62 in the horizontal direction 30 through the opening 20 and into the second portion 19 of the housing 15. As further illustrated in FIG. 3, a first sensor 46 is provided, to transmit a stop signal 47 to the controller 40 when the system 10 reaches the intermediate stage (FIG. 2B) after the picture 22 has moved by the threshold distance 62 in the horizontal direction 30, so that the controller 40 can deactivate the power supply 44, motor 42 and the first actuator 24, upon receiving the stop signal 47 from the first sensor 46. In a subsequent phase of the system 10 in the forward mode, from the intermediate stage (FIG. 2B) to the final stage (FIG. 2C), the controller 40 activates the power supply 44, which in-turn activates the motor 42 to activate the second actuator 26, so that the picture 22 and the display mount 13 simultaneously move along the cavity 14 until the display mount 13 is visible through the opening 20. Similarly, as further illustrated in FIG. 3, a second sensor 48 is provided, to transmit a stop signal 49 to the controller 40 when the system 10 reaches the final stage (FIG. 2C) after the display mount 13 is aligned with the opening 20, so that the controller 40 can deactivate the power supply 44, motor 42 and the second actuator 26, upon receiving the stop signal 49 from the second sensor 48. In an exemplary embodiment, the first and second sensors may be limit switches, optical sensors or linear encoders, for example.

During a reverse mode of the system 10, from an initial stage (FIG. 2C) to an intermediate stage (FIG. 2B), the second sensor 48 is similarly configured to transmit the stop signal 49 to the controller 40 when the system 10 reaches the intermediate stage (FIG. 2B), to deactivate the power supply 44, motor 42 and second actuator 26, upon receiving the stop signal 49 from the second sensor 48. Also, during the reverse mode of the system 10 from the intermediate stage (FIG. 2B) to the final stage (FIG. 2A), the first sensor 46 is similarly configured to transmit the stop signal 47 to the controller 40 when the system 10 reaches the final stage (FIG. 2A), to deactivate the power supply 44, motor 42 and first actuator 24, upon receiving the stop signal 47 from the first sensor 46.

As further illustrated in FIG. 3, a user input device 52 is provided, to initiate the initial phase of the system 10 in the forward mode from the initial stage (FIG. 2A) to the intermediate stage (FIG. 2B), by transmitting a signal to the controller 40. Upon receiving the signal from the user input device 52, the controller 40 activates the power supply 44, motor 42 and first actuator 24, to move the picture 22 through the opening 20 and behind the wall 16. As discussed above, the first actuator 24 moves the picture 22 until the controller 40 receives the stop signal 47 from the first sensor 46 and then deactivates the first actuator 24. Furthermore, the user input device 52 can also be used, to subsequently initiate the subsequent phase of the system 10 in the forward mode from the intermediate stage (FIG. 2B) to the final stage (FIG. 2C), by transmitting a second signal to the controller 40. Upon receiving the second signal from the user input device 52, the controller 40 activates the power supply 44, motor 42 and second actuator 26, to simultaneously move the picture 22 and the display mount 13 such that the display mount 13 is visible through the opening 20. As discussed above, the second actuator 26 simultaneously moves the picture 22 and the display 13 until the controller 40 receives the stop signal 49 from the second sensor 48 and deactivates the second actuator 26.

In an exemplary embodiment, the user input device 52 is a biometric sensor configured to detect a biometric input of the user or an optical sensor configured to detect an optical sensor carried by the user, for example. Additionally, the user input device 52 may be a concealed device, such as a concealed access pad, for example. In order to reveal and provide access to the concealed user input device 52, a secondary user input device 54, such as a biometric sensor or optical sensor, may be provided, to detect an input of the user, and provide access to the user input device 52, so the user can provide input to the user input device 52, such as providing a code to an access pad, for example.

As further illustrated in FIG. 3, the system 10 includes an optional safety sensor 50 positioned within the threshold spacing 28 (FIG. 2C) between the picture 22 and the display mount 13. Upon activation of the second actuator 26 and simultaneous movement of the picture 22 and the display mount 13 along the cavity 14, the safety sensor 50 monitors whether an object such as a user's hand passes into the threshold spacing 28. If the safety sensor 50 detects an object passing into the threshold spacing 28 and/or applying pressure to the system 10 during the activation of the second actuator 26, the safety sensor 50 transmits a stop signal 51 to the controller 40, after which the controller 40 deactivates the power supply 44, motor 42 and second actuator 26, to prevent possible injury to the user of the system 10. In an exemplary embodiment, the safety sensor may be a pressure sensor or a motion sensor, for example.

Figure 4:
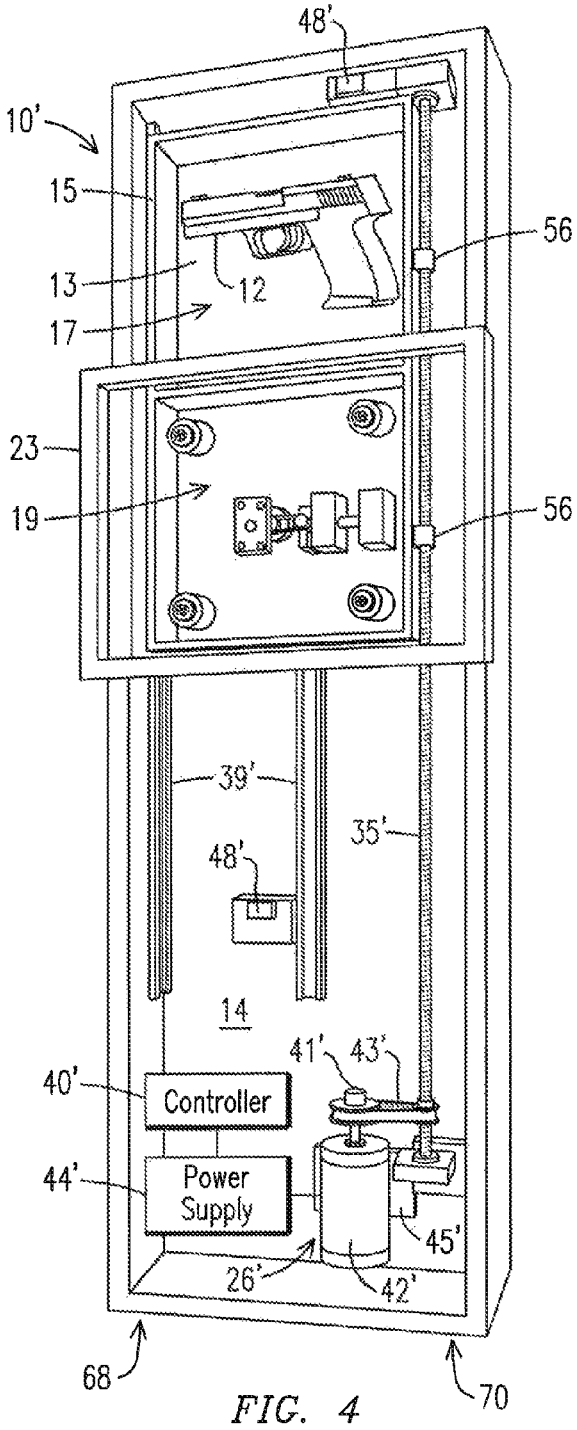
FIG. 4 is a front view of an exemplary embodiment of a system for concealing objects within a wall of a room according to the present invention.
Figure 5:
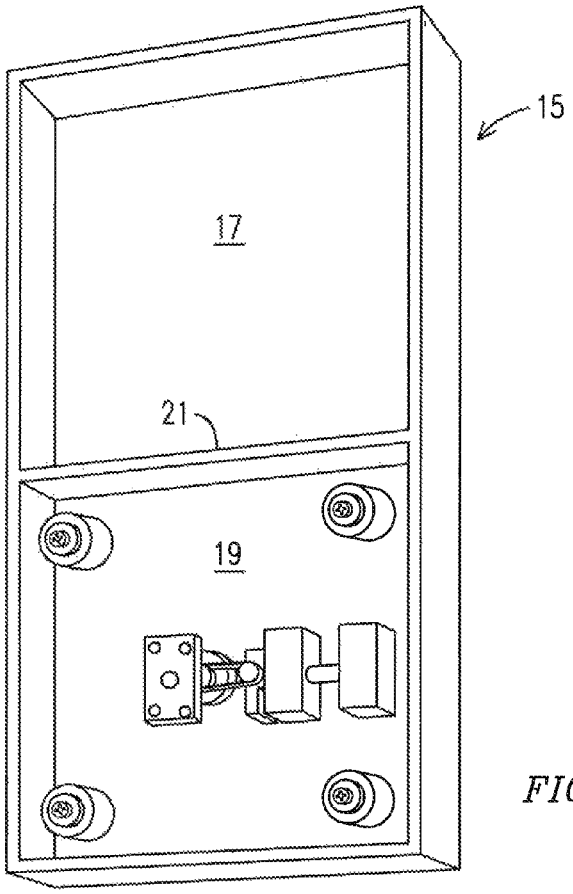
FIG. 5 is a front view of a housing used in the system of FIG. 4.
Figure 6:
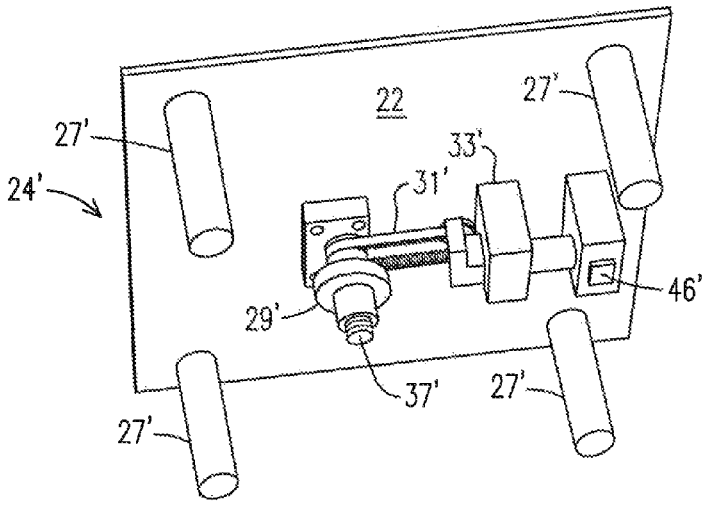
FIG. 6 is a bottom perspective view of a first actuator used in the system of FIG. 4.
Figure 7:
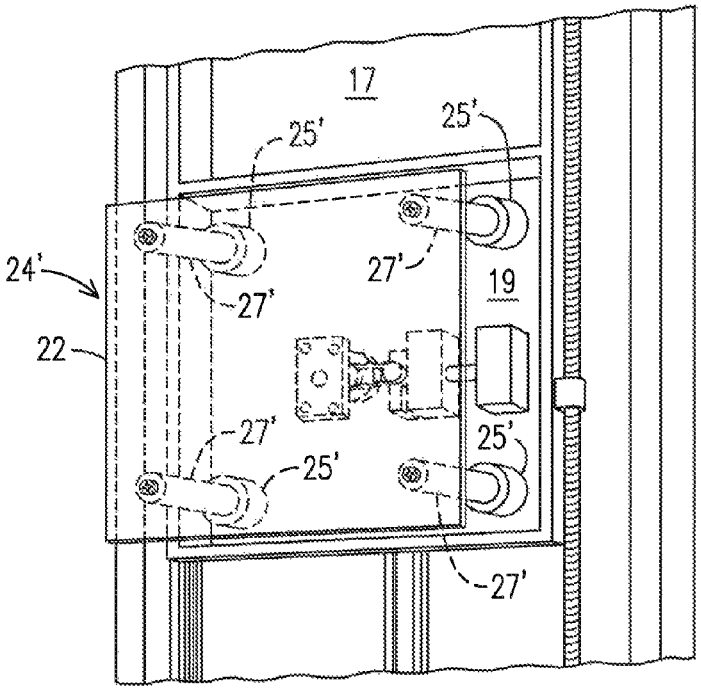
FIG. 7 is a top perspective view of a first actuator used in the system of FIG. 4.
Figure 8:
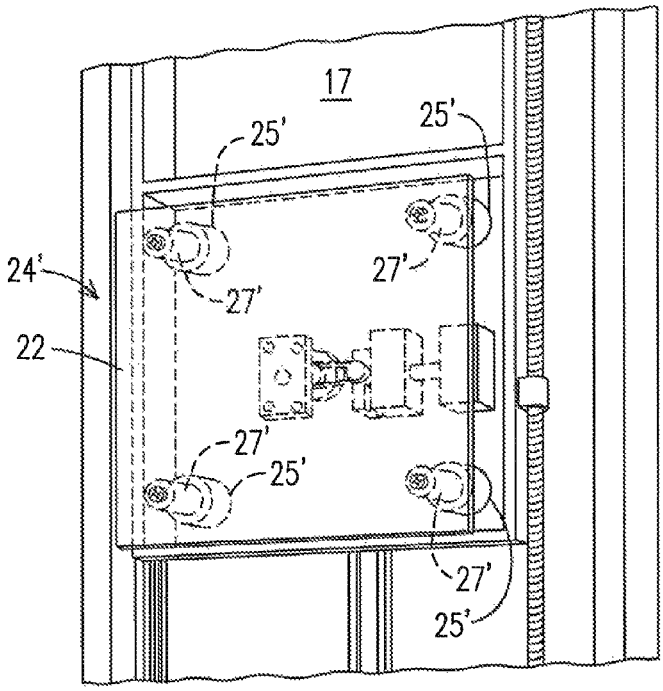
FIG. 8 is a top perspective view of a first actuator used in the system of FIG. 4.

FIGS. 4-10 illustrate an alternate embodiment of the system 10' for concealing objects within a building. FIG. 4 illustrates the system 10', in which the picture 22 is aligned with the frame 23 and the opening (not shown). FIG. 5 illustrates the housing 15 of the system 10', which is similar to the housing 15 of the system 10 discussed above, including a first portion 17 of the housing 15 for the display mount 13 to secure the firearm 12 and a second portion 19 of the housing 15 for the first actuator 26' (discussed below), where the first and second portions 17, 19 are separated by a dividing wall 21. FIG. 6 illustrates the first actuator 24' including linear rods 27' secured to each corner of a back surface of the picture 22. A lead screw 37' is also secured to the back surface of the picture 22 with a gear wheel 29' that is connected to a pulley 31'. The pulley 31' is actuated by a motor 33' mounted to the back surface of the picture 22. FIG. 7 illustrates the first actuator 24' when the system 10' is in the initial position, since the linear rods 27' are in an extended position from respective linear bearings 25', where the linear bearings 25' are mounted to each corner of the second portion 19 of the housing 15. Thus, the picture 22 is at an extended position and is positioned within the frame 23 at the opening in the wall (not shown).

The system 10' moves from the initial position (FIG. 7) to an intermediate position (FIG. 8), in which the linear rods 27' are in a retracted position within the respective linear bearings 25', and thus the picture 22 moves through the opening (not shown) in the wall and to the second portion 19 of the housing 15. As with the system 10 discussed above, to move the system 10' from the initial position (FIG. 7) to the intermediate position (FIG. 8), a user provides input to a user input device, which in-turn causes the controller 40' to transmit a signal to the motor 33' of the first actuator 24', to actuate the pulley 31' and the gear wheel 29', and rotate the lead screw 37' to move the picture 22 to the second portion 19 of the housing 15, as in FIG. 8. As illustrated in FIG. 6, the first actuator 26' includes a first sensor 46' which transmits a signal to the controller 40', when the back surface of the picture 22 has moved into the intermediate position (FIG. 8), and upon receiving the signal from the first sensor 46', the controller 40' deactivates the motor 33'.

Figure 9:
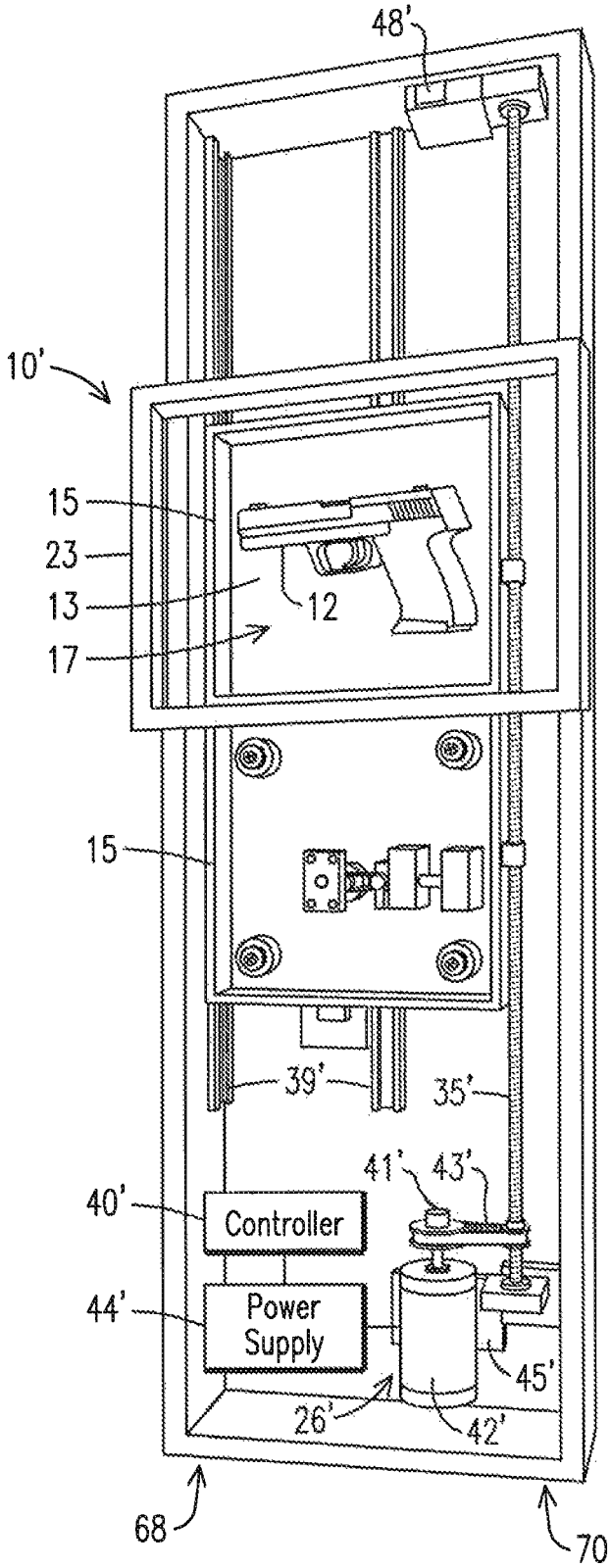
FIG. 9 is front view of the system illustrated in FIG. 4.
Figure 10:
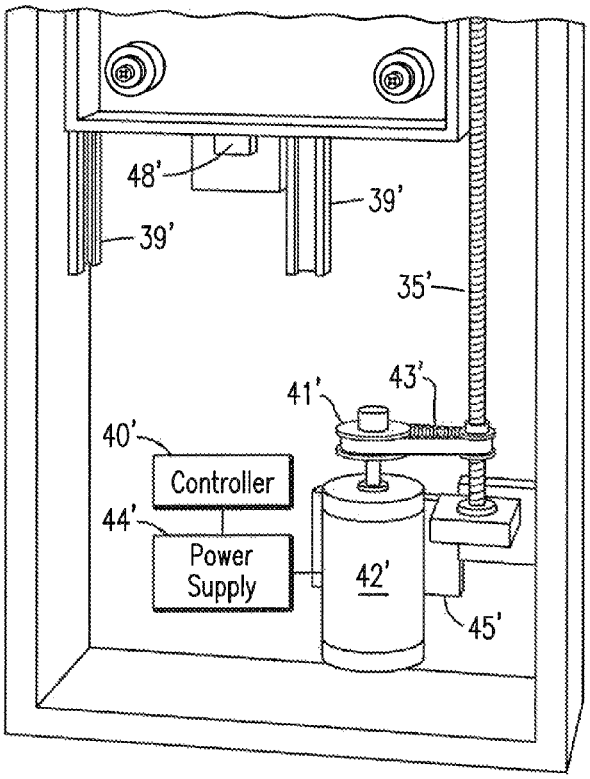
FIG. 10 is a partial front view of the system illustrated in FIG. 4.

FIGS. 9-10 illustrate the second actuator 26' of the system 10'. As illustrated in FIGS. 9-10, the second actuator 26' includes a lead screw 35' positioned on one side 70 of the cavity 14, and is secured along one side of the housing 15 with lead screw nuts 56. The second actuator 26' also includes a pulley 43' that is connected to the lead screw 35', as well as a gear wheel 41' which actuates the pulley 43', thereby causing the lead screw 35' to rotate and move the housing 15 (i.e. simultaneously move the picture 22 and display mount 13) along the cavity 14. The second actuator 26' further includes a motor 42' which is secured to a motor mount 45' within the cavity 14. In addition to the lead screw 35' positioned along the side 70 of the cavity 14, FIG. 4 illustrates that rails 39' are respectively positioned along an opposite side 68 of the cavity 14 and along a center of the cavity 14, to assist in guiding the housing 15 along the cavity 14.

To move the system 10' from the intermediate position (FIG. 4) in which the picture 22 is positioned within the frame 23 and at the opening (not shown) of the wall, to the final position (FIG. 9) where the display mount 13 is visible through the frame 23 and the opening (not shown) of the wall, a user provides a user input to the controller 40', which in-turn transmits a signal to the power supply 44'. The power supply 44' activates the motor 42', which subsequently rotates the gear wheel 41', which drives the pulley 43', and causes the lead screw 35' to rotate, thereby moving the housing 15 along the cavity 14 from the intermediate position (FIG. 4) to the final position (FIG. 9). A second sensor 48' (FIG. 10) is provided, to transmit a signal to the controller 40' when the housing 15 has moved a sufficient amount such that the system 10' is in the final position and the display mount 13 is visible through the opening in the wall.

As illustrated in FIG. 4, a pair of second sensors 48' are provided at the respective ends of the range of motion of the housing 15 along the cavity 14. When the user wants to move the system 10' in a reverse direction, from the final position (FIG. 9) to the intermediate position (FIG. 4), the second sensor 48' at the opposite end of the range of motion of the housing 15 is configured to transmit a signal to the controller 40' when the housing 15 reaches the intermediate position (FIG. 4). Similarly, when the user wants to move the system 10' in the reverse direction from the intermediate position (FIG. 4) to the initial position (FIG. 7), the first sensor 46' of the first actuator 24' is configured to transmit a signal to the controller 40' when the picture 22 reaches the initial position (FIG. 7), and upon receiving the signal, the controller 40' transmits a signal to shut down the motor 33'.

Figure 11:
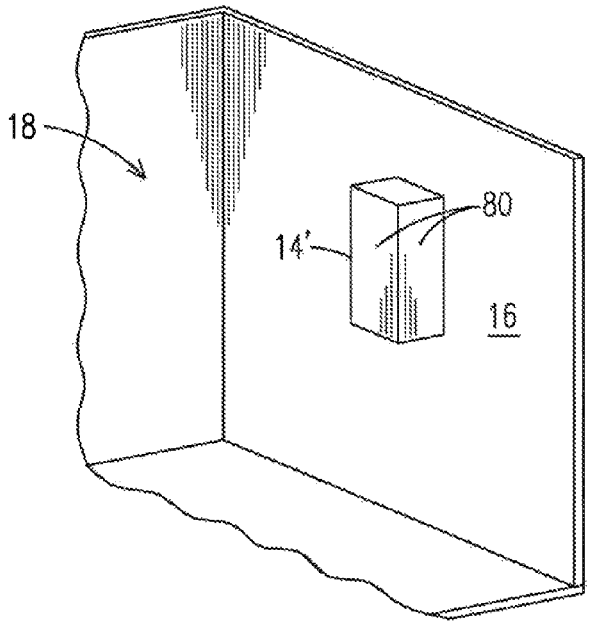
FIG. 11 is a plan view of a cavity within a room to house a system according to the present invention.

Although the embodiments of the systems 10, 10' discussed above and illustrated in FIGS. 2A and 4 are positioned in a cavity 14 within the wall 16 of the room 18, the embodiments of the present invention are not limited to this arrangement, since the system may be positioned within a cavity within any interior surface of a room. Additionally, as illustrated in FIG. 11, a cavity 14' is provided that includes a plurality of surfaces 80, where the cavity 14' is mounted to an interior surface of the room 18, such as to an interior of the wall 16 of the room, for example. Thus, the system may be mounted within the cavity 14' that is contained within an interior volume of the room 18, and need not be positioned within a cavity within an interior surface of the room 18.

Figure 12:
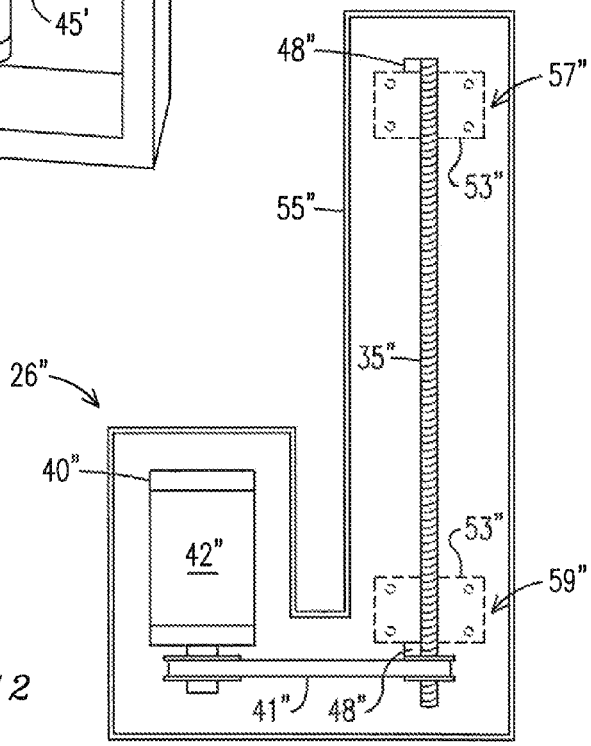
FIG. 12 is a sectional view of an alternative first actuator to be used in the system of FIG. 4.

FIG. 12 illustrates an isolated view of an alternate second actuator 26" to be used in the system for concealing objects within, the building discussed above. As illustrated in FIG. 12, the second actuator 12" includes a housing 55" with a rotatably mounted lead screw 35" that is similar to the lead screw 35 discussed above in the system 10. A motor 42" is also positioned within the housing 55" and is configured to activate a gear wheel 41" which in turn rotates the lead screw 35". A plate 53" is attached to an outer surface of the housing 55" and is configured to slide along a length of the housing 55" from a first position 57" to a second position 59", based on the rotation of the lead screw 35". A second sensor 48" is positioned at either end of the housing 55", such that a second sensor 48" detects when the plate 53" reaches the first position 57", after which the second sensor 48" transmits a signal to the controller 40", so that the controller 40" deactivates the motor 42", to stop the lead screw 35". Additionally, as illustrated in FIG. 12, a second sensor 48" is positioned to detect when the plate 53" reaches the second position 59", after which the second sensor 48" transmits a signal to the controller 40", so that the controller 40" deactivates the motor 42", to stop the lead screw 35". In operation, the plate 53" includes threaded holes which are used to secure one or more bolt or fasteners, which are then secured to the back surface of the housing 15 (FIG. 4). Thus, as the lead screw 35" moves the plate 53" from the first position 57" to the second position 59" and back again, the housing 15 within the cavity 14 moves from the intermediate position (FIG. 2B) to the final position (FIG. 2C) and back again. When the housing 15 travels from the intermediate position (FIG. 2B) to the final position (FIG. 2C), the second sensor 48" detects that the plate 53" has reached the second position 59" and transmits a signal to the controller 40" to stop the lead screw 35", so that the housing 15 remains in the final position (FIG. 2C). After a user input or other input to activate the second actuator 26", and the housing 15 travels from the final position (FIG. 2C) to the intermediate position (FIG. 2B), the second sensor 48" detects that the plate 53" has reached the first position 57" and transmits a signal to the controller 40" to stop the lead screw 35", so that the housing 15 remains in the intermediate position (FIG. 2B). The plate 53" is secured along the back surface of the housing 15, at a location such that the vertical range of motion of the plate 53" between the first position 57" and the second position 59" is equal to the displacement between the intermediate position (FIG. 2B) and the final position (FIG. 2C).

Figure 13:
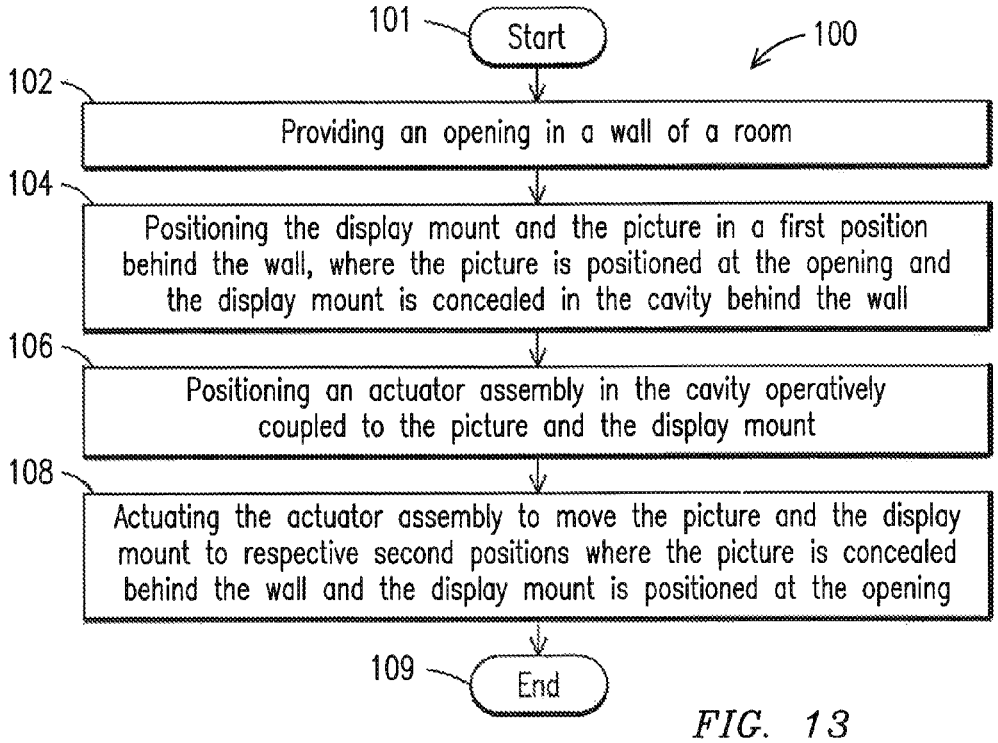
FIG. 13 is a flowchart depicting a method for concealing valuables within a system for concealing objects within a wall of a room.

FIG. 13 illustrates a flowchart depicting a method 100 for concealing and accessing objects behind the wall 16 of the room 18. The method 100 starts at 101 by providing 102 the opening 20 in the wall 16 of the room 18. The method 100 also includes positioning 104 the display mount 13 and the picture 22 in a first position behind the wall 16, where the picture 22 is positioned at the opening 20 and the display mount 13 is concealed in the cavity 14 behind the wall 16. The method 100 further includes positioning 106 an actuator assembly 29 in the cavity 14 operatively coupled to the picture 22 and the display mount 13. The method 100 further includes actuating 108 the actuator assembly 29 to move the picture 22 and the display mount 13 to respective second positions, where the picture 22 is concealed behind the wall 16 and the display mount 13 is positioned at the opening 20, before the method ends at 109.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

That which is claimed is:

1. A system for concealing and accessing objects behind a wall of a room, said system comprising:

an opening defined by the wall;

a mount in which a firearm is secured and positioned in a cavity behind the wall of the room;

a picture within a stationary frame mounted to the wall at the opening; and an actuator assembly positioned in the cavity and operatively coupled to the mount and picture to move the picture from the opening and to move the mount to the opening to access the firearm, said actuator assembly comprising:

a horizontal actuator configured to move the picture in a horizontal direction approximately orthogonal to the wall into and out of the opening and into a housing defining the cavity, and a vertical actuator configured to simultaneously move the picture and the mount in a vertical approximately parallel to the wall along the cavity until the firearm is accessible through the opening, wherein the picture and the firearm are spaced apart.

2. The system of claim 1, wherein said vertical actuator comprises:

a lead screw;

a plurality of lead screw nuts configured to secure the picture and the mount to the lead screw; and a controller to activate the lead screw in the vertical direction upon input from a user and to deactivate the lead screw upon the mount being visible through the opening.

3. The system of claim 2, wherein said vertical actuator further comprises a first sensor configured to transmit a stop signal to the controller upon the mount being visible through the opening; and wherein said controller is configured to deactivate the lead screw upon detection of the stop signal from the first sensor.

4. The system of claim 2, wherein subsequent to the mount being visible through the opening, said controller is configured to activate the lead screw in an opposite vertical direction to the vertical direction upon input from a user; wherein said vertical actuator further comprises a second sensor configured to transmit a stop signal to the controller upon the picture being visible through the opening; and wherein said controller is configured to deactivate the lead screw upon detection of the stop signal from the second sensor.

5. The system of claim 2, further comprising a vertical rail oriented along a first side of the cavity, wherein the lead screw is oriented along a second side of the cavity opposite from the first side of the cavity; wherein a first side of the picture and the mount are slidably mounted along the vertical rail and wherein a second side of the picture and mount are secured to the lead screw with the lead screw nuts.

6. The system of claim 1, wherein said vertical actuator comprises:

a linear actuator with a first member having a first diameter and a second member having a second diameter smaller than the first diameter, wherein the picture and the mount are secured to the second member; and a controller to activate the linear actuator in the vertical direction upon input from a user such that the second member is received within the first member and to deactivate the linear actuator upon the mount being visible through the opening.

7. The system of claim 1, wherein said horizontal actuator comprises:

a linear actuator with a first member having a first diameter and a second member having a second diameter smaller than the first diameter, wherein the picture is secured to the second member; and a controller to activate the linear actuator in the horizontal direction upon input from a user such that the second member is received within the first member and to deactivate the linear actuator upon the picture having moved by a threshold distance.

8. The system of claim 7, wherein the threshold distance is a sum of a thickness of the wall and a minimum clearance threshold.

9. A system for concealing and accessing objects behind a wall of a room, said system comprising:

a display mount positioned in a cavity behind the wall, wherein valuables are secured to the display mount;

an opening defined by the wall;

a picture positioned at the opening and a frame mounted to the wall around the opening; and and actuator positioned in the cavity and operatively coupled to the display mount and the picture, the actuator assembly comprising:

a first actuator coupled to an inner surface of the picture to move the picture through the opening and into the cavity, and a second actuator coupled to the picture and the display mount to simultaneously move the picture and the display mount such that the display mount and the valuables are accessible through the opening, wherein the picture and the display mount are spaced apart.

10. A method for concealing and accessing objects behind an interior surface of a room, said method comprising:

providing an opening in the interior surface of the room;

positioning a display mount and a décor element in a first position behind the interior surface, wherein in the first position the décor element is positioned at the opening and the display mount is concealed in a cavity behind the interior surface;

positioning an actuator assembly in the cavity, said actuator assembly operatively coupled to the décor element and the display mount, including:

positioning a first actuator in the cavity, said first actuator coupled to the décor element and configured to move the décor element into and out of the opening, and positioning a lead screw in the cavity and securing the décor element and the display mount to the lead screw with a plurality of lead screw nuts, said lead screw coupled to the décor element and the display mount and configured to move the décor element and the display mount along the cavity until the display mount is positioned at the opening, and actuating the actuator assembly to move the décor element and the display mount to respective second positions, wherein in the second positions the décor element is concealed behind the interior surface and the display mount is positioned at the opening.

11. The method of claim 10, further comprising:

activating the lead screw in a vertical direction upon receiving input from a user;

transmitting a stop signal from a first sensor when the display mount is visible through the opening; and deactivating the lead screw upon the display mount being positioned at the opening.

* * * * *